US006178971B1

(12) United States Patent
Schweer et al.

(10) Patent No.: US 6,178,971 B1
(45) Date of Patent: Jan. 30, 2001

(54) FROSTING CAP AND METHOD OF USE

(76) Inventors: Janet Schweer, 107 Redbird Ct., Edgewood, KY (US) 41018-2660; Janet Eisenmenger, 3266 Millakin Pl., Burlington, KY (US) 41005

( * ) Notice: Under 35 U.S.C. 154(b), the term of this patent shall be extended for 0 days.

(21) Appl. No.: 09/320,965

(22) Filed: May 27, 1999

(51) Int. Cl.[7] ..... A45D 19/18; A45D 24/00; A61K 7/13

(52) U.S. Cl. ..... 132/270; 132/208; 132/200

(58) Field of Search ..... 132/270, 208, 132/202, 200, 274, 273, 275, 212

(56) References Cited

U.S. PATENT DOCUMENTS

| | | | | |
|---|---|---|---|---|
| 1,265,426 | | 5/1918 | Chernov et al. . | |
| 2,051,714 | | 8/1936 | Huntington . | |
| 2,174,263 | | 9/1939 | Guglielmi . | |
| 2,251,191 | | 7/1941 | Kelley . | |
| 2,857,917 | | 10/1958 | Cortez . | |
| 3,143,117 | | 8/1964 | Ruud . | |
| 3,249,113 | * | 5/1966 | Sobeck | 132/270 |
| 3,351,073 | | 11/1967 | Gregg . | |
| 3,401,703 | | 9/1968 | Claycomb . | |
| 3,468,318 | * | 9/1969 | Cook et al. | 132/270 |
| 3,586,009 | | 6/1971 | Sirmons . | |
| 4,165,754 | * | 8/1979 | Di Pasqua | 132/270 |
| 4,298,014 | | 11/1981 | MacLennan . | |
| 4,481,680 | | 11/1984 | Mason et al. | 2/174 |
| 4,760,855 | | 8/1988 | DiLorenzo . | |
| 4,964,175 | | 10/1990 | Taylor | 2/171 |
| 5,024,244 | * | 6/1991 | Brown | 132/270 |
| 5,042,511 | * | 8/1991 | Haddad | 132/270 |
| 5,287,864 | * | 2/1994 | Gallo | 132/208 |
| 5,524,650 | * | 6/1996 | Ponce | 132/270 |
| 5,562,111 | * | 10/1996 | Torres | 132/270 |
| 5,621,919 | | 4/1997 | Graham | 2/174 |

FOREIGN PATENT DOCUMENTS

| | | |
|---|---|---|
| 2405638 | 2/1975 | (DE) . |

* cited by examiner

*Primary Examiner*—John J. Wilson
*Assistant Examiner*—Robyn Kieu Doan
(74) *Attorney, Agent, or Firm*—Wood, Herron & Evans LLP

(57) ABSTRACT

A frosting cap is designed to only cover the lower portion of the head leaving the upper portion of the head uncovered. This allows the shorter lower hairs to be highlighted by pulling them through perforations in the frosting cap and applying the dye. Upper hairs which tend to be longer can then be highlighted by segregating the bundles of hair, applying dye and encasing them in sheeting such as aluminum foil.

8 Claims, 3 Drawing Sheets

FROSTING CAP AND METHOD OF USE

When hair is highlighted or frosted, selected strands of hair are treated with either a dye or a bleach (hereinafter collectively referred to simply as dye) to alter the selected hair's color so it is distinguished from the remaining hair. In order to do so, the dye must be applied to the selected hairs and that treated hair must be separated from the remaining hairs or else the dye will bleed into adjacent hairs creating an undesirable effect.

There are two methods used to separate the hairs. The first is a frosting cap which is simply a plastic cap much like a raincap which has a series of perforations spaced throughout the cap. The cap is placed over the individual's head utilizing a device similar to a knitting needle, the hair dresser pulls bundles of hairs through the perforations so that the strands of hair are separated from the remaining hair. The bleach or dye is applied to these selected hairs with the cap keeping the bleach or dye from contacting the remaining hair. This is very effective for short hair. Longer hair is difficult if not impossible to pull through the small perforation.

For longer hair, hair dressers use aluminum foil as a means to separate the selected bundles of hair. Basically strands of hair are separated from the remaining hair. The selected strands are placed on aluminum foil. The dye or bleach is applied to these selected strands and then the aluminum foil is folded back over the strands of hair separating them from the remaining hairs. This is repeated to achieve the desired result. The aluminum foil functions well for longer hairs but is very difficult to apply with shorter hairs. Certain hair styles leave the upper hairs longer than the lower hairs. This makes it difficult to utilize either method to frost hair.

SUMMARY OF THE INVENTION

The present invention is premised on the realization that one can frost hair more easily utilizing a frosting cap which covers only the sides and back of the head. Such a frosting cap if properly fastened acts to separate hairs to be dyed from hairs which should not be dyed and can be utilized very easily by the hair dresser. The upper portion of the head can then be highlighted utilizing standard methods such as aluminum foil or the like.

In a preferred embodiment the frosting cap of the present invention incorporates a lower unperforated sheet which can be folded up over the frosting cap after the dye is applied to separate any upper hairs from the dye applied to the hairs pulled through the frosting cap. Utilizing this method significantly simplifies highlighting of hair and thereby reduces the amount of time required to highlight an individual's hair.

The objects and advantages of the present invention will be further appreciated in light of the following detailed description and drawings in which:

DETAILED DESCRIPTION

Figure 1:
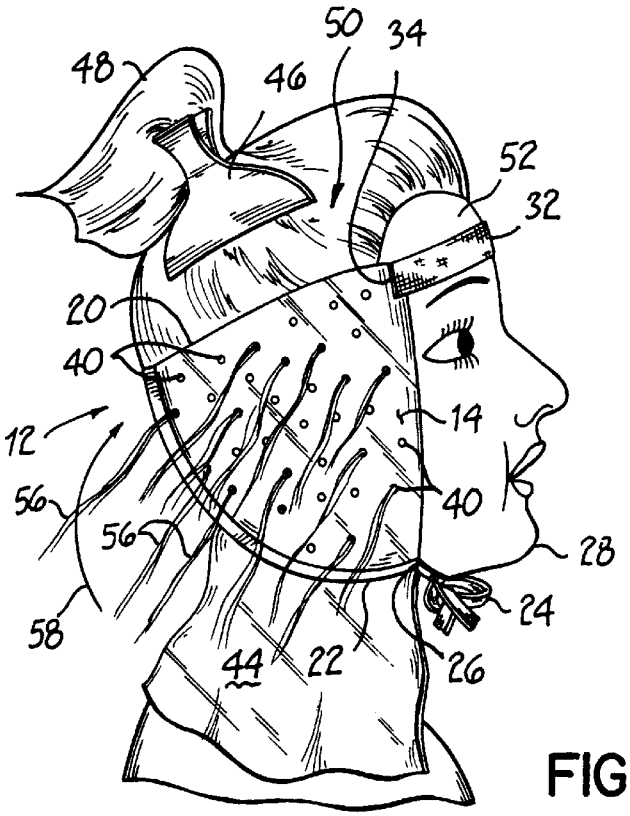
FIG. 1 is a side view of the present invention as used on an individual.

As shown in FIG. 1, the present invention is a frosting cap 12 which includes a first side panel 14, a second side panel 16 and a back panel 18 which extends from side panel 14 to side panel 16. The cap further includes an upper edge 20 and lower edge 22. Two straps 24 extend from corners 26 at the lower edge 22 of the cap. Only one side shown. These straps are designed to be tied together beneath the chin 28 of an individual.

The frosting cap of the present invention also includes an upper fastening system which includes a first upper strap 32 extended from upper corner 34 and a second upper strap (not shown) extended from the opposite upper corner. These straps 32 include hook and pile (velcro™) fasteners. Alternatively, the upper fastening system could simply be tie strings or pressure sensitive adhesive coated straps or simply adhesive tape designed to adhere to the forehead of the individual.

Extended downwardly from the lower edge 22 is a lower sheet 44 which should have a length equal to the distance from the upper edge 20 to the lower edge 22.

Preferably the frosting cap of the present invention is formed from plastic sheetings such as polyethylene and includes a plurality of perforations 40 which can be spaced anywhere from a quarter inch to an inch apart with about a half inch being preferred. Again, the spacing of the holes is a matter of choice. The size of the holes is further a matter of choice and generally will be in the neighborhood of about ⅛ of an inch. The panels 14, 16 and 18 themselves preferably include two layers, the outer layer being perforated and a coextensive inner layer (not shown) which is not perforated. This inner layer is punctured as hair is pulled through the perforation 40. It acts to prevent dye from leaking through any holes which are not filled with hair.

Figure 2:
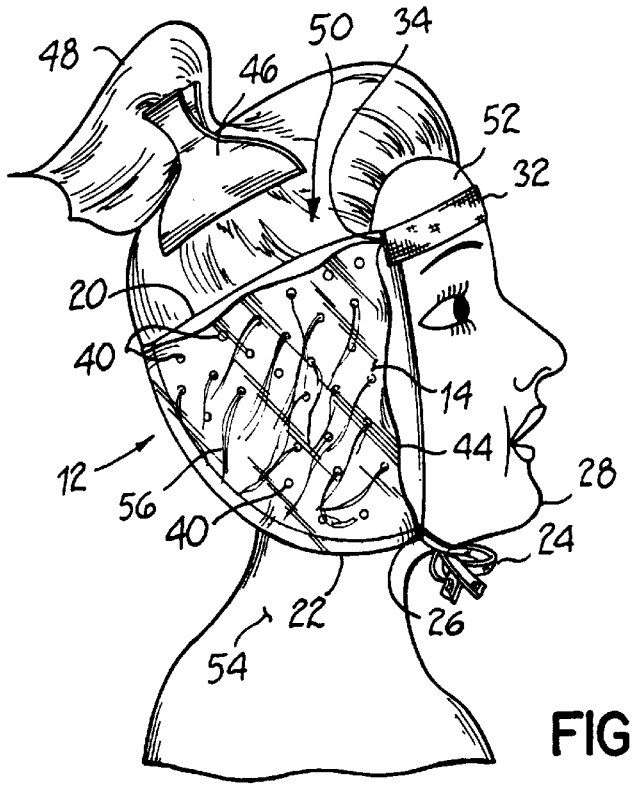
FIG. 2 is a side view of the present invention with the lower flap raised.
Figure 3:
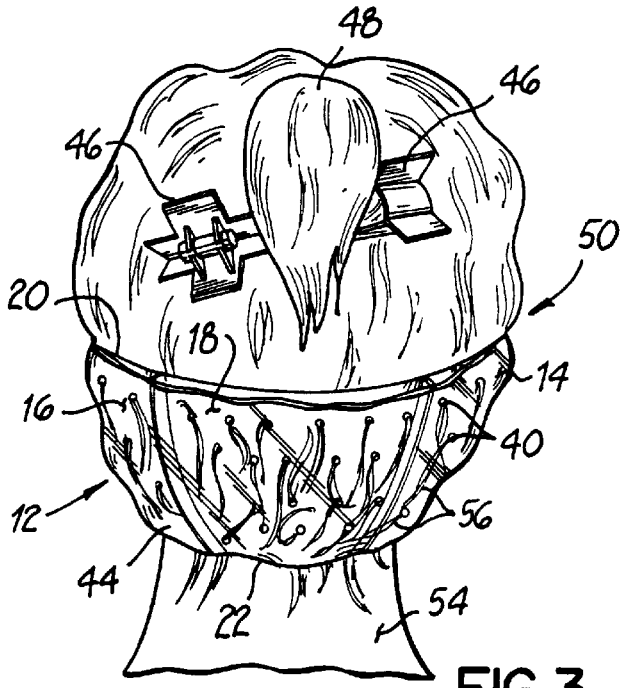
FIG. 3 is a rear view of the present invention in use.

The frosting cap 12 of the present invention is used by tying it about the head of an individual. As shown in FIGS. 1 and 2, hair clips 46 are used to pull the upper hair 48 away from the lower portion 50 of the head. The frosting cap 12 is then applied beneath this pulled up hair 48. The lower straps 24 are tied together beneath the chin and straps 32 are fastened together using the hook and pile portion about the forehead 52 of an individual. Sheet 44 hangs down covering the neck 54 of the individual.

As shown in FIG. 1, bundles of hair 56 are then pulled the individual holes. This is done by simply passing a needle similar to a knitting needle through the perforations and poking a hole through the inner sheet. The bundle of hair 56 is then collected by the barb of the needle and pulled back through the hole where it extends out as shown in FIG. 1.

A dye or bleach is then applied to the hairs 56 that are extended through these holes. Sheet 44 is folded back over the hairs 56 as shown by arrow 58. A piece of adhesive tape (not shown) or a clip can be applied to hold this in position.

Figure 4:
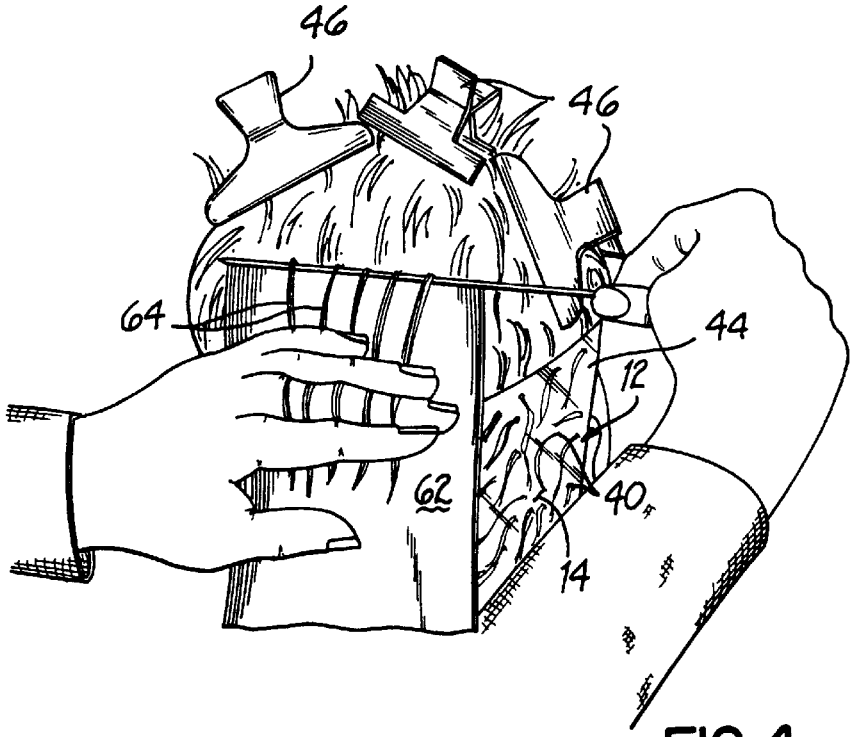
FIG. 4 is a diagrammatic depiction of the utilization of the present invention.
Figure 5:
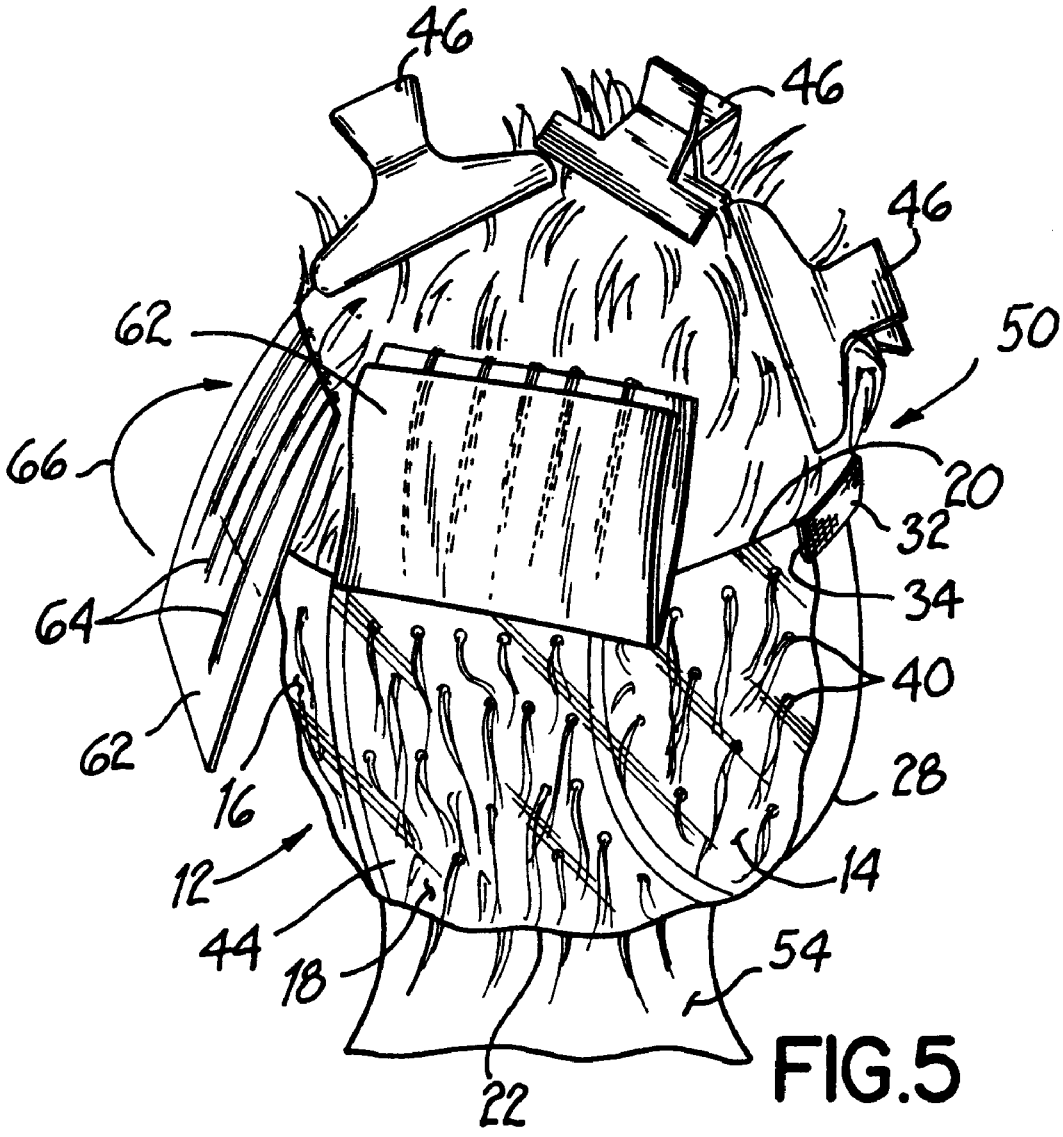
FIG. 5 is a further diagrammatic depiction of the utilization of the present invention.

As shown in FIGS. 4 and 5, sheets 62 of aluminum foil are then used to apply dye or bleach to selected strands of the upper portion of the head 48. This is done by segregating bundles of hair 64 and placing these over sheets 62 of aluminum foil as shown in FIG. 4. The hair which is not selected lies under the foil. Dye is then applied to the selected hairs 64 resting on the aluminum foil. The aluminum foil is then folded back on itself as shown by arrow 66 of FIG. 5. This is continued until selected strands of hair from the entire upper portion of the head are highlighted.

After the dye has had a sufficient period of time to alter the color of the selected strands of hair, the aluminum foil and frosting cap are removed and the hair is washed to remove the remaining dye or bleach.

Thus the present invention allows the hair dresser to quickly highlight hair. The frosting cap facilitates highlighting shorter hairs along the sides of the lower portion of the head whereas the upper portion of the head is quickly highlighted using aluminum foil or other plastic sheeting to segregate the highlighted hairs. Further, the lower flap portion of the frosting cap when folded up traps in heat which accelerates the dying process. The frosting cap itself is relatively inexpensive and disposable further facilitating clean-up.

This has been a description of the present invention along with the preferred method of practicing the present invention.

However, the invention itself should only be defined by the appended claims wherein we claim:

1. A frosting cap comprising a perforated sheet configured to cover the lower portions of a head;

said cap comprises a first side, a second side and a back side and an upper edge, a first fastener at about said upper edge adapted to hold said upper edge around the upper portion of said head at about a forehead portion of said head, said sides adapted to cover substantially the entire head below said forehead, said cap open above said upper edge to thereby leave a top portion of said head uncovered by said cap, said cap further comprising an unperforated flap attached to an edge of said cap and adapted to fold over and cover said perforated sheet.

2. The frosting cap claimed in claim 1 further comprising a lower fastening system adapted to hold a lower portion of said cap fastened beneath a chin portion of said head.

3. The frosting cap claimed in claim 2 wherein said lower fastening system comprises tie strings.

4. The frosting cap claimed in claim 2 wherein said first fastener comprises a first and second strap adapted to attach to each other.

5. The frosting cap claimed in claim 4 wherein said straps include complimentary hook and pile fasteners.

6. The frosting cap claimed in claim 4 wherein said first and second straps include pressure sensitive adhesive.

7. A method of highlighting hair comprising covering the lower portion of said head with a frosting cap said frosting cap comprising a perforated sheet configured to cover the lower portions of a head;

said cap comprising a first side, a second side and a back side and an upper edge, said sides adapted to cover substantially the entire head below said forehead, said cap open above said upper edge to thereby leave a top portion of said head uncovered by said cap, fastening said cap about a forehead portion of said head with said sides covering said head below said forehead portion;

pulling selected bundles of hair through said perforations in said sheet and applying dye to said selected bundles of hair;

covering said selected bundles; and further highlighting hairs on the upper portion of said head wherein said highlight is applied to said upper portions of said hair by segregating second bundles of hair and covering said second bundles of hair with dye and enclosing said second bundles of hair in a plurality of unperforated sheets.

8. The method claimed in claim 7 wherein said unperforated sheet comprises aluminum foil.

* * * * *

UNITED STATES PATENT AND TRADEMARK OFFICE

CERTIFICATE OF CORRECTION

PATENT NO. : 6,178,971 B1
DATED : January 30, 2001
INVENTOR(S) : Janet Eisenmenger and Janet Schweer It is certified that error appears in the above-identified patent and that said Letters Patent is hereby corrected as shown below:

Column 2,
Line 46, reads "bundles of hair 56 are then pulled the individual holes" and should read -- bundles of hair 56 are then pulled through the individual holes --.

Column 4, claim 5,
Line 5, reads "include complimentary" should read -- include complementary --.

Column 4, claim 8,
Line 35, reads "unperforated sheet comprises" should read -- unperforated sheets comprise --.

Signed and Sealed this

First Day of January, 2002

*Attest:*

*Attesting Officer*

JAMES E. ROGAN
*Director of the United States Patent and Trademark Office*